US011111677B2

(12) United States Patent
Kotiadis et al.

(10) Patent No.: US 11,111,677 B2
(45) Date of Patent: Sep. 7, 2021

(54) SIDING CLIP

(71) Applicant: Fiber Composites, LLC, New London, NC (US)

(72) Inventors: Petros D. Kotiadis, Albemarle, NC (US); Rick A. Lappin, New London, NC (US); Eric J. Helda, Cornelius, NC (US); Eric L. Niederer, Albemarle, NC (US)

(73) Assignee: Fiber Composites, LLC, New London, NC (US)

( * ) Notice: Subject to any disclaimer, the term of this patent is extended or adjusted under 35 U.S.C. 154(b) by 0 days.

(21) Appl. No.: 16/573,406

(22) Filed: Sep. 17, 2019

(65) Prior Publication Data

US 2020/0087922 A1 Mar. 19, 2020

Related U.S. Application Data

(60) Provisional application No. 62/733,396, filed on Sep. 19, 2018.

(51) Int. Cl.

| | |
|---|---|
| ***E04F 13/08*** | (2006.01) |
| ***E04B 1/41*** | (2006.01) |
| *E04B 1/38* | (2006.01) |

(52) U.S. Cl.

CPC ..... *E04F 13/0846* (2013.01); *E04B 1/40* (2013.01); *E04B 2001/405* (2013.01)

(58) Field of Classification Search

CPC ..... E04F 13/0826; E04F 13/0844; E04F 13/0846; E04F 13/0894;

(Continued)

(56) References Cited

U.S. PATENT DOCUMENTS 937,984 A * 10/1909 Brown ..... E04H 12/24 52/40
1,452,515 A * 4/1923 Kearney ..... F16B 13/0858 248/231.91

(Continued)

FOREIGN PATENT DOCUMENTS

| | | | |
|---|---|---|---|
| DE | 565350 C * | 11/1932 | ..... E04B 1/40 |
| EP | 2198097 | 6/2010 | |
| WO | WO 2017/160205 | 9/2017 | |

OTHER PUBLICATIONS

International Search Report for Application No. PCT/US2019/051498, dated Dec. 5, 2019.

(Continued)

*Primary Examiner* — Brian D Mattei
*Assistant Examiner* — Joseph J. Sadlon
(74) *Attorney, Agent, or Firm* — K&L Gates LLP

(57) ABSTRACT

A siding clip may include at least one tab having a tab through hole, a base having at least one base through hole, and a side portion affixed to an edge of the at least one tab at a first side portion end and to an edge of the base at a second side portion end, thereby forming a gap between the at least one tab and the base. The tab through hole is disposed opposite to one of the at least one base through holes. The siding clip further includes at least one coupling flange having a plane parallel to a plane of the at least one tab, and having at least one insertion feature. The at least one coupling flange is disposed in a direction opposite to a direction of the at least one tab.

13 Claims, 12 Drawing Sheets

(58) Field of Classification Search
CPC ..... E04F 2015/02094; E04F 13/007; E04F 13/0825; E04B 1/40; E04B 2001/405
USPC ..... 52/698
See application file for complete search history.

(56) References Cited

U.S. PATENT DOCUMENTS 2,081,368 A * 5/1937 Pretot ..... E04B 2/62 52/489.1
2,293,744 A * 8/1942 Miles ..... E04F 13/007 52/547
2,338,870 A * 1/1944 Praeger ..... E04B 1/6104 52/582.1
2,588,673 A * 3/1952 Tyson ..... E04D 1/34 52/546
2,672,314 A * 3/1954 Mitchell ..... A47G 1/1653 248/301
2,733,036 A * 1/1956 Meletio ..... G01R 11/04 52/27
2,827,317 A * 3/1958 Saulnier ..... B60D 1/02 403/157
2,831,222 A * 4/1958 Anderson ..... E04F 13/0846 52/489.1
4,074,811 A * 2/1978 Filak ..... E04B 1/24 211/182
4,110,948 A * 9/1978 Maier, Jr. ..... E04D 3/3608 52/402
4,178,063 A * 12/1979 Reynolds ..... H01H 85/202 439/831
4,266,384 A * 5/1981 Orals ..... E04B 9/22 52/407.1
4,337,048 A * 6/1982 Hatch ..... A61B 5/16 434/219
4,481,749 A * 11/1984 Stirling ..... E04F 13/0826 52/714
4,601,247 A * 7/1986 Welch ..... A47B 57/20 108/108
H129 H * 9/1986 Hansen ..... E02B 3/068 52/764
4,646,501 A * 3/1987 Champagne ..... E04F 13/0864 52/520
4,925,141 A * 5/1990 Classen ..... E04B 1/2612 248/217.2
5,046,897 A * 9/1991 Ray ..... E02B 3/068 405/221
5,370,202 A * 12/1994 Nichols ..... A62B 35/04 182/3
5,546,723 A * 8/1996 Jones ..... E04B 1/0007 411/163
5,617,690 A * 4/1997 Gibbs ..... E04D 1/34 52/518
5,860,257 A * 1/1999 Gerhaher ..... E04F 13/0826 52/235
5,896,720 A * 4/1999 Bond ..... E04D 13/12 24/336
6,131,358 A * 10/2000 Wise ..... E04B 1/2612 52/289
6,484,465 B2 * 11/2002 Higgins ..... E04F 13/081 52/235
6,540,432 B2 * 4/2003 Albanese ..... E04F 13/085 403/231
6,766,992 B1 * 7/2004 Parker ..... F16M 13/022 248/218.4
6,941,716 B2 * 9/2005 Kottman ..... E04B 2/7422 248/220.1
6,966,531 B2 * 11/2005 Curtin ..... E04G 21/3261 248/237
7,201,355 B1 * 4/2007 Zien ..... A01K 5/01 248/301
7,398,623 B2 * 7/2008 Martel ..... E04B 5/12 411/461
7,823,853 B2 * 11/2010 Larson ..... F21V 21/088 248/339
8,020,353 B2 * 9/2011 Gaudreau ..... E04F 13/0864 52/520
8,468,764 B2 * 6/2013 Degen ..... E04B 2/8635 52/489.1
9,072,381 B2 * 7/2015 Bates ..... A47B 96/067
9,850,666 B2 12/2017 Libreiro et al.
10,633,853 B2 * 4/2020 Erlebach ..... A47K 3/405
2002/0051680 A1 * 5/2002 Albanese ..... F16B 2/20 403/388
2005/0252154 A1 * 11/2005 Martel ..... F16B 15/0038 52/712
2014/0199117 A1 * 7/2014 Kikuchi ..... E04F 13/0846 403/380
2017/0298634 A1 * 10/2017 Marchesi ..... E04F 13/0814
2017/0314278 A1 * 11/2017 Lee ..... E04G 23/0285
2018/0016797 A1 * 1/2018 Suzuki ..... E04F 13/0828
2019/0071878 A1 * 3/2019 Lindberg ..... E04F 13/0846
2019/0309525 A1 * 10/2019 Santarossa ..... E04F 19/0486
2019/0309527 A1 * 10/2019 Bergelin ..... E04F 15/04
2020/0018076 A1 * 1/2020 Fahle ..... E04F 13/0826

OTHER PUBLICATIONS

International Preliminary Report on Patentability and Written Opinion for Application No. PCT/US2019/051498, dated Apr. 1, 2021.

* cited by examiner

SIDING CLIP

BACKGROUND

The exterior surfaces of buildings are exposed to a variety of environmental conditions that can cause damage if the surfaces are not suitably protected. Examples of such environmental conditions include, without limitation, direct sunlight, rain, snow, hail, wind, and wind-driven objects (such as dirt, sand, and larger debris). Damage to the exterior surfaces of buildings over time, may lead to surface damage, including pitting, bleaching, and cracking. Longer exposure may result in severe structural damage that may result in cracks and, ultimately, loss of some amount of structural integrity of the side of the building. Siding, or rain screens, may be used to cover the exterior surfaces of building, thereby protecting them from the environment. Modular siding, especially, may be useful in that siding portions may be replaced when the portion of the siding is damaged.

Modular siding may be composed of any suitable material to withstand the environmental conditions including, without limitation, wood, polymers, metal, or a wood-polymer composites. Wood-polymer composites are especially useful material in that they may be fabricated of materials having specific properties. Examples of such properties may include insect resistance, mold resistance, sun bleaching resistance, and fire resistance. Additionally, wood-polymer composites may be fabricated to have any number of surface appearances that may mimic wood, stone, or other materials.

As disclosed above, a benefit of modular siding is that one or more portions of the siding can be installed and removed from the exterior surface of a building. It may be recognized that a modular siding portion that is affixed directly to the building exterior, for example through the use of nails or screws, may be difficult to remove if necessary and may result in damage to the builder exterior surface. In some aspects, one or more siding clips may be attached to the siding portions to permit easy installation and removal of individual siding portions.

SUMMARY

Aspects of a siding clip are disclosed that are configured to: (1) secure one or more modular siding portions against vertical and lateral displacement; (2) insert into a groove of a vertically adjacent siding portion to releasably secure a lower siding portion against an upper siding portion; (3) permit air motion both vertically and horizontally in the space between the siding portion and the adjacent exterior surface of the building; and (4) be inconspicuous to an observer of the siding.

In one aspect, a siding clip may include at least one tab including a tab through hole, a base including at least one base through hole, a side portion affixed to an edge of the at least one tab at a first side portion end and to an edge of the base at a second side portion end, thereby forming a gap between the at least one tab and the base, wherein the tab through hole is disposed opposite to one of the at least one base through holes, and at least one coupling flange having a plane parallel to a plane of the at least one tab and including at least one insertion feature, in which the at least one coupling flange is disposed in a direction opposite to a direction of the at least one tab.

FIGURES

Figure 2:
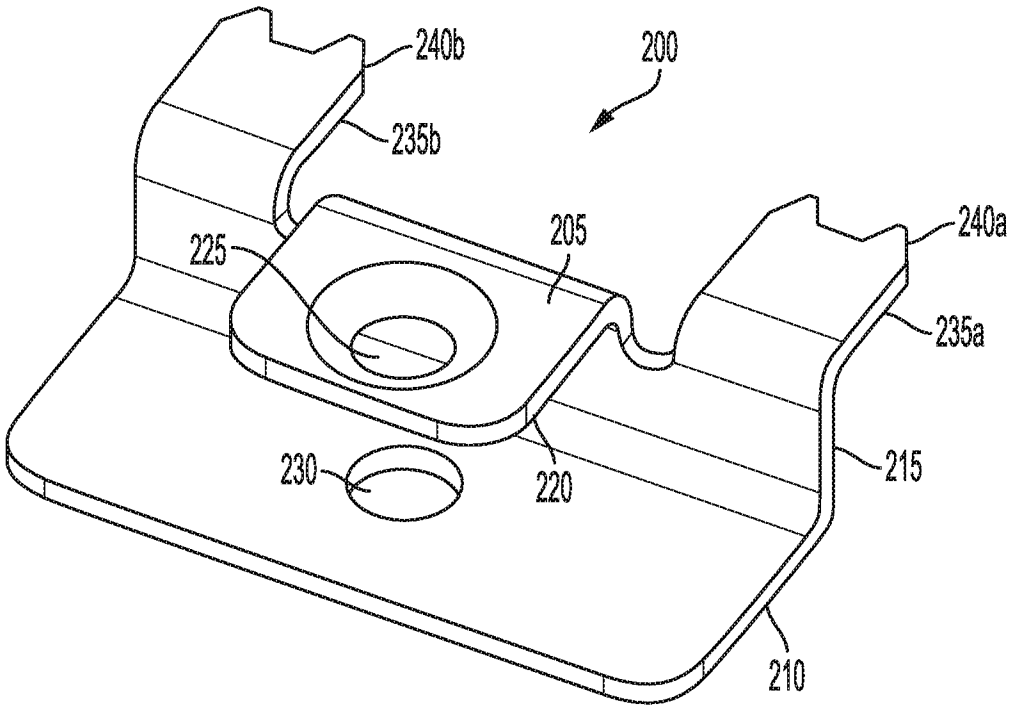
FIG. 2 depicts a perspective view of one aspect of a siding clip in accordance with at least one aspect of the present disclosure.
Figure 4B:
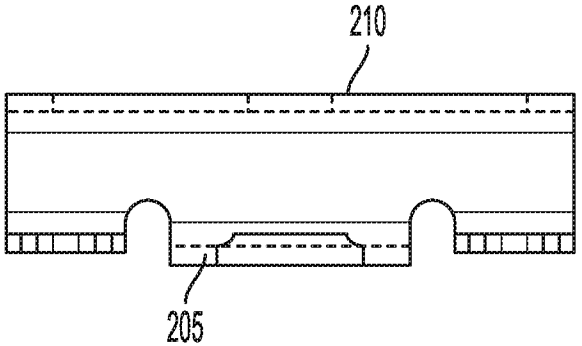
Figure 4A:
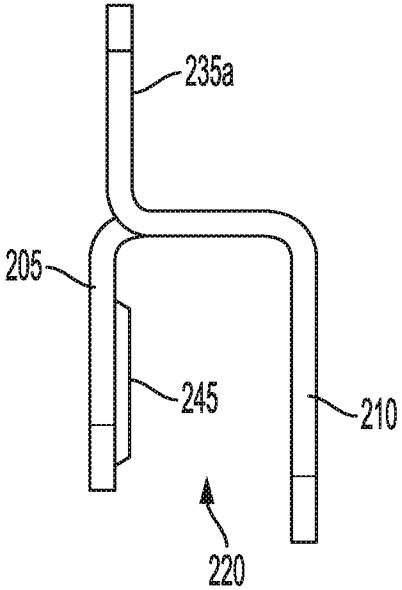

FIGS. 4A,B depict a side plan view and a front plan view, respectively, of the siding clip depicted in FIG. 2 in accordance with at least one aspect of the present disclosure.

Figure 5:
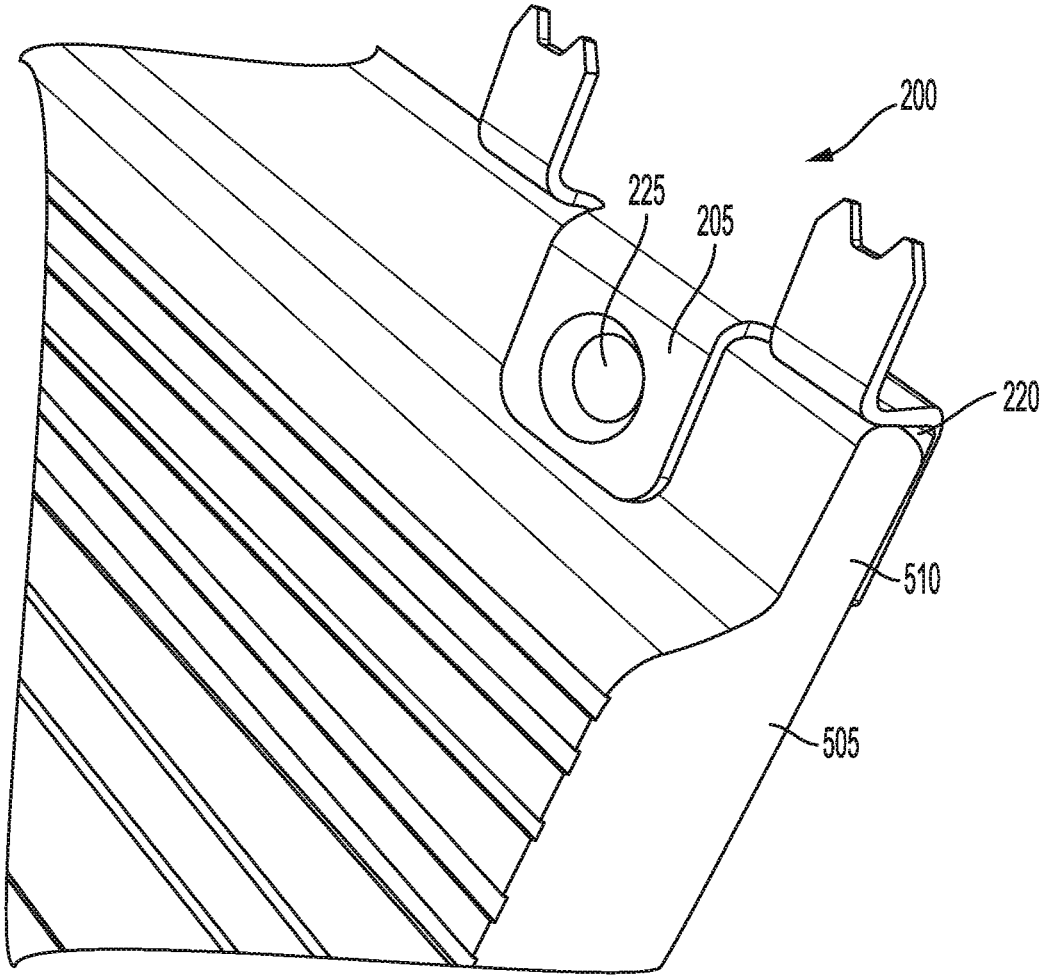

FIG. 5 illustrates a front perspective view of the siding clip depicted in FIG. 2 attached to an edge portion of a modular siding portion in accordance with at least one aspect of the present disclosure.

Figure 6:
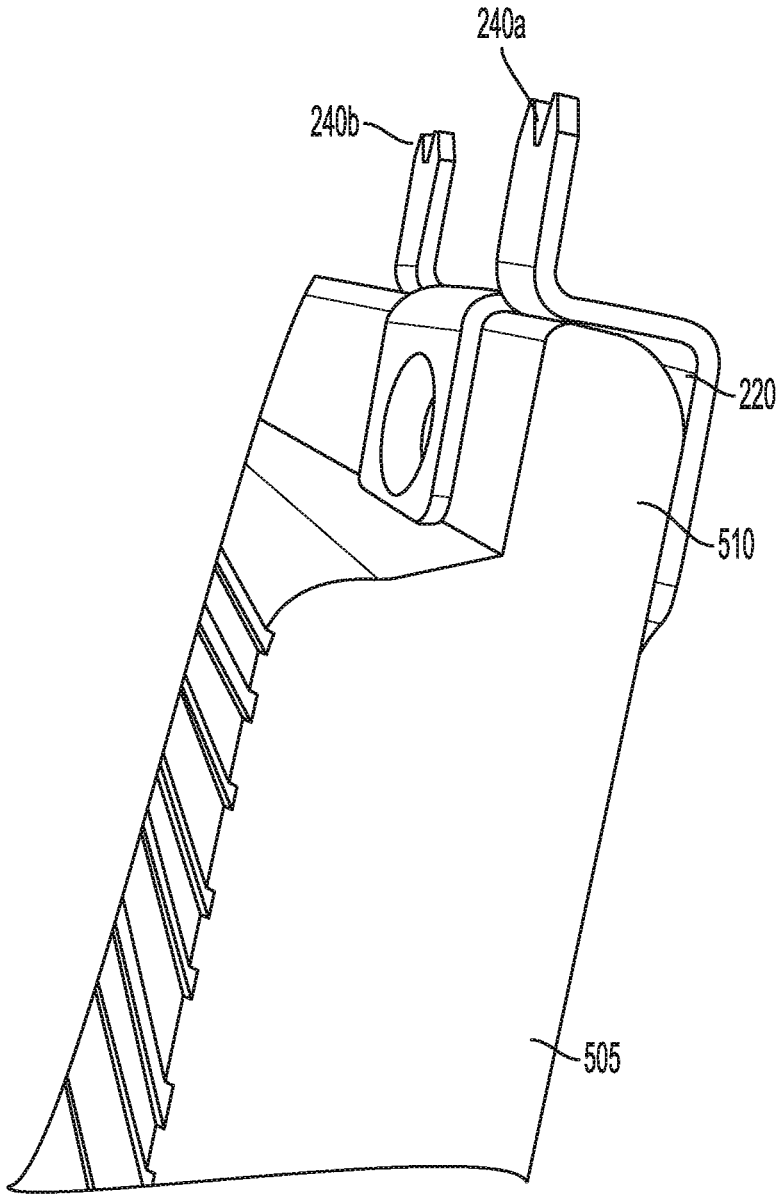

FIG. 6 illustrates a side perspective view of the siding clip depicted in FIG. 2 attached to an edge portion of a modular siding portion in accordance with at least one aspect of the present disclosure.

Figure 7:
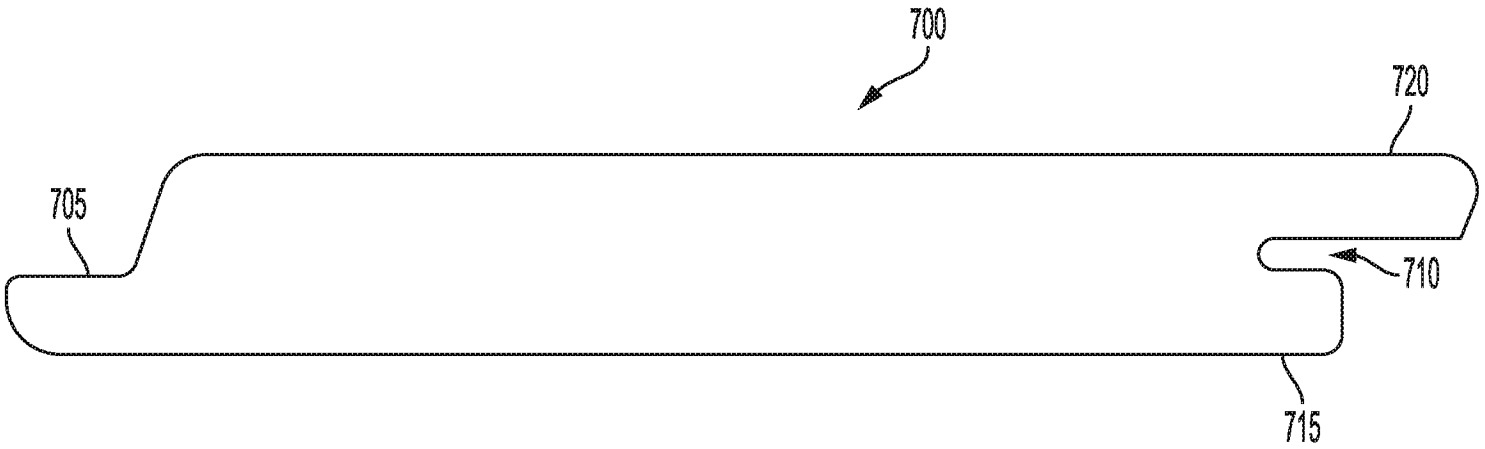

FIG. 7 depicts a side plan view of a modular siding portion for use with the siding clip depicted in FIG. 2 in accordance with at least one aspect of the present disclosure.

Figure 8:
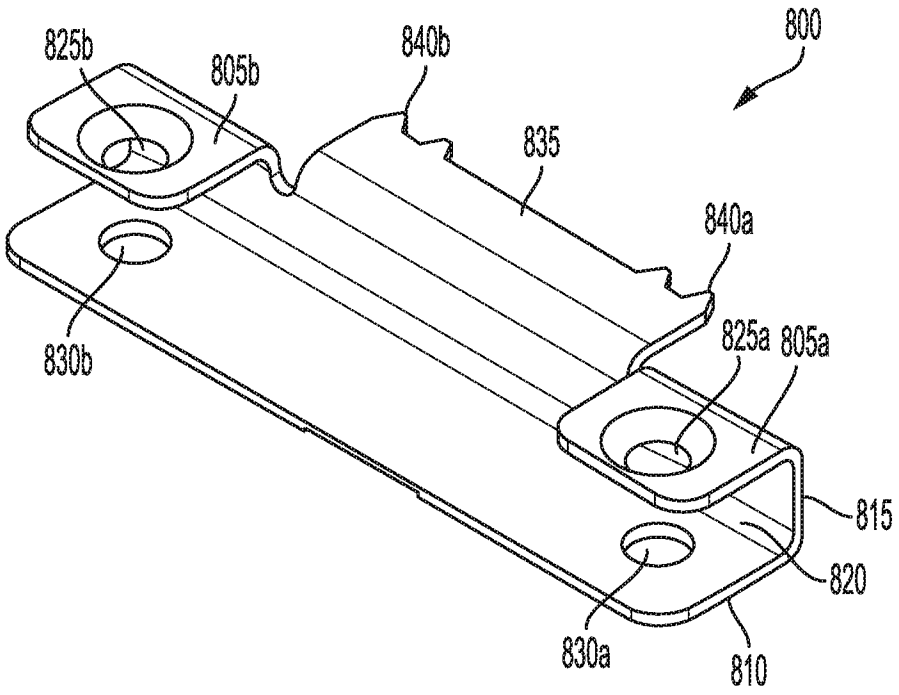

FIG. 8 depicts a perspective view of a second aspect of a siding clip in accordance with at least one aspect of the present disclosure.

Figure 9:
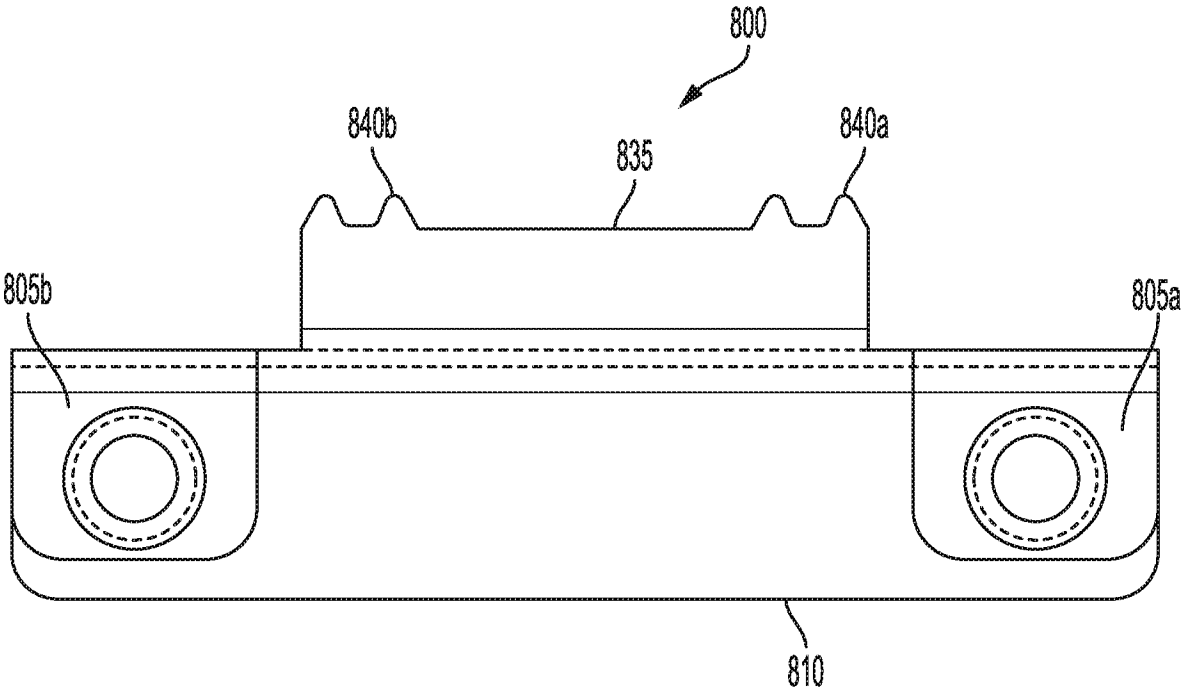

FIG. 9 depicts a top plan view of the siding clip depicted in FIG. 8 in accordance with at least one aspect of the present disclosure.

Figure 10A:
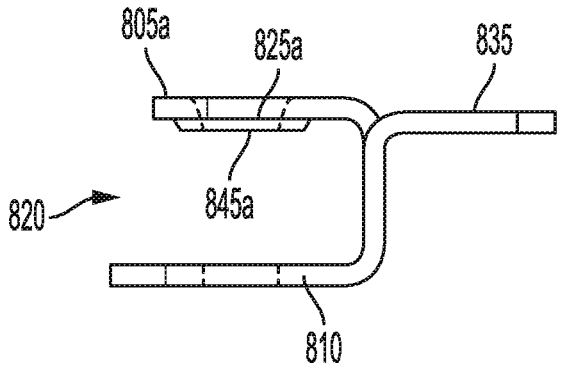

FIGS. 10A,B depict a side plan view and a front plan view, respectively, of the siding clip depicted in FIG. 8 in accordance with at least one aspect of the present disclosure.

Figure 11:
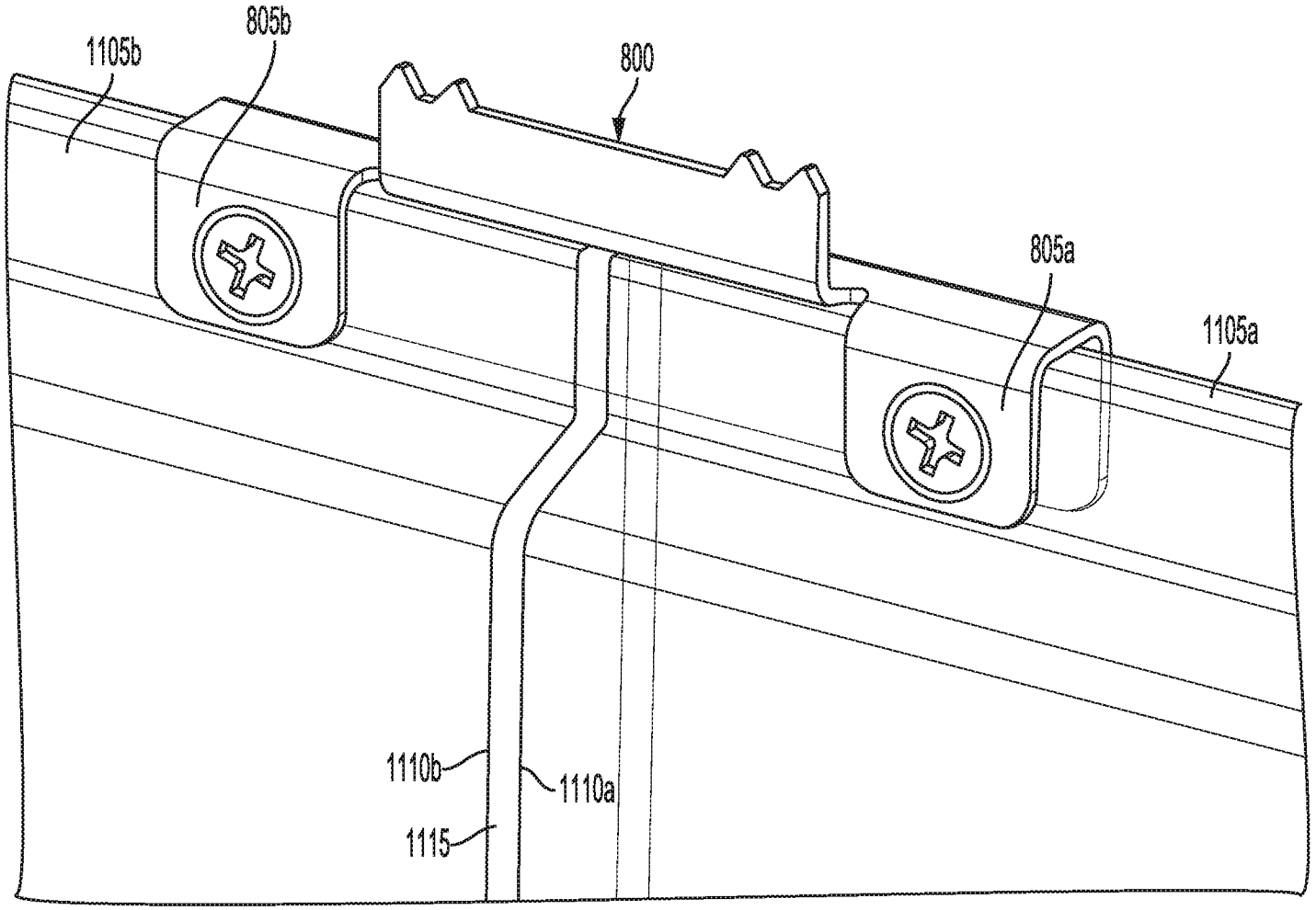

FIG. 11 illustrates a use of the siding clip depicted in FIG. 8 in securing the butt ends of two siding portions in accordance with at least one aspect of the present disclosure.

Figure 12:
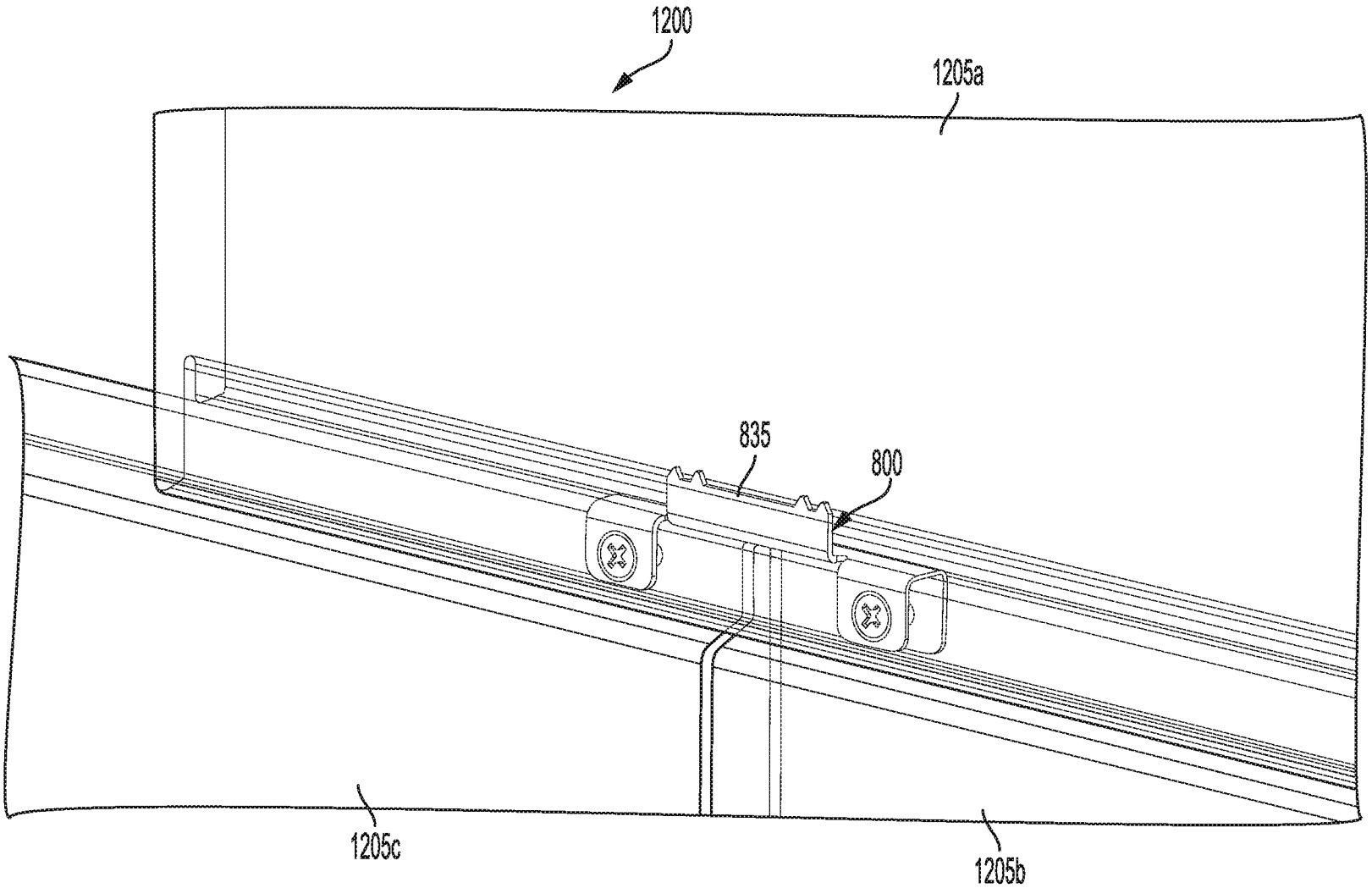

FIG. 12 illustrates an installation of multiple siding portions together using the siding clip depicted in FIG. 8 in accordance with at least one aspect of the present disclosure.

DETAILED DESCRIPTION

As disclosed above, a modular siding portion that is affixed directly to the building exterior, for example through the use of nails or screws, may be difficult to remove if necessary and may result in damage to the builder exterior surface. To obviate this disadvantage, one or more siding clips may be attached to the siding portions to permit easy installation and removal of individual siding portions. Several aspects of a siding clip may improve its utility in attaching one or more siding portions to a building exterior surface. It is advantageous for a siding clip to securely hold the individual siding portions together. It is further advantageous that the siding clip not be visible to an observer. It is further advantageous that the siding clip be able to permit air motion, both vertically and horizontally, in the space between the siding portions and the building exterior surface. These, and other features, may be advantageously incorporated into the structure and design of the siding clips. Disclosed below are aspects of a siding clip that incorporates such advantageous features.

Figure 1:
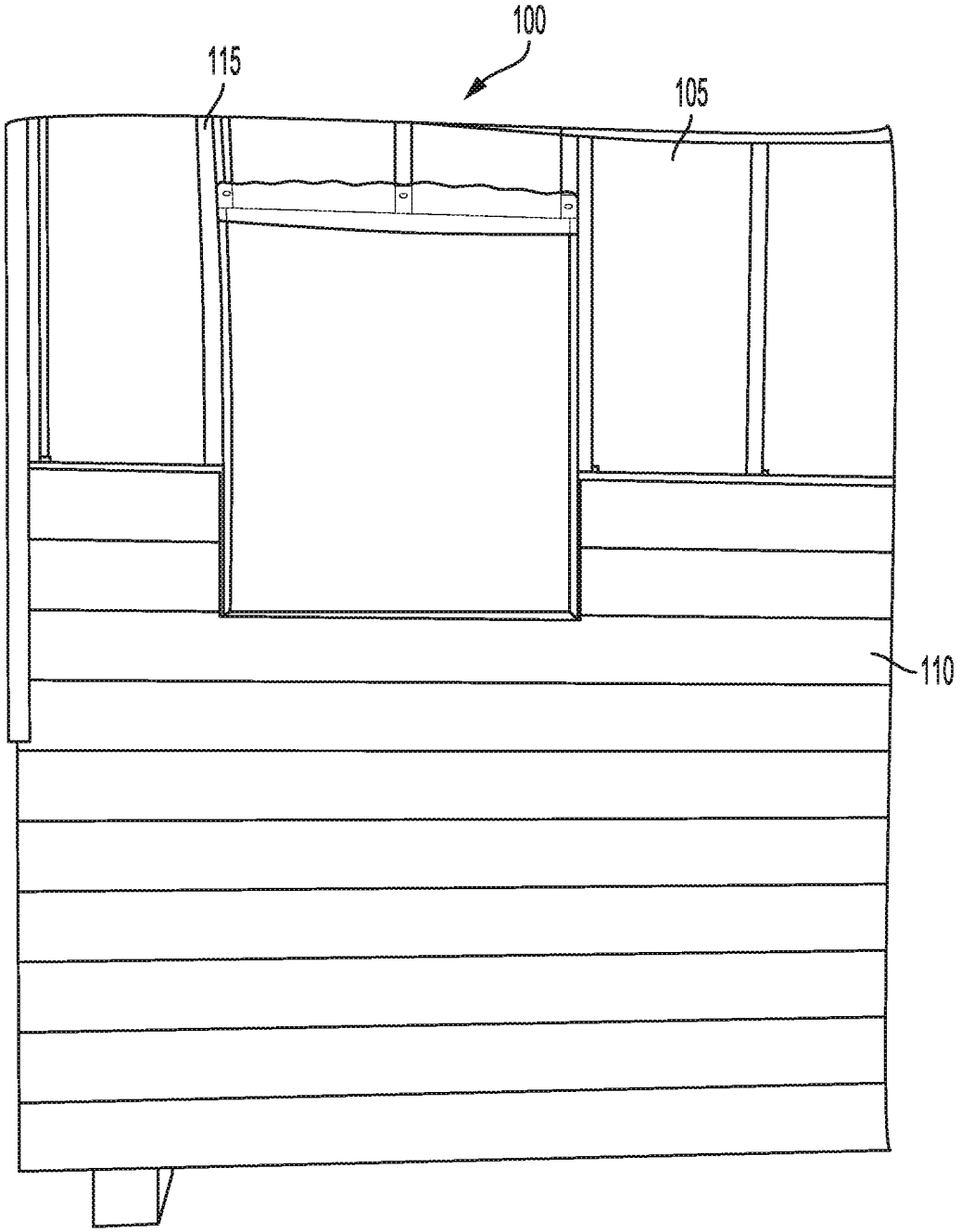
FIG. 1 illustrates a partial installation of modular siding portions against an exterior surface of a building in accordance with at least one aspect of the present disclosure.

FIG. 1 illustrates an example of an installation 100 of multiple siding portions 110 against an exterior surface of a building. The exterior surface of the building may be covered by a covering material 105 such as an insulating material or a waterproofing material to help protect the building exterior surface or provide additional insulating capabilities. Attached to the exterior surface of the building may be ferring strips 115 to which the siding portions may be secured. The ferring strips 115 additionally provide an air space between the siding portions and the building exterior.

Such an air space may permit air to move against the building surface to prevent moisture build-up and to provide an air space in pressure equilibrium with the external air pressure. As a result of this air space, a pressure differential on opposing sides of the siding portions 110 may be avoided, and thus prevent the siding portions 110 from being subjected to air pressure forces during extreme weather (such as hurricanes). It may also be noticed in FIG. 1 that the siding clips used to secure the siding portions 110 to each other and to the underlying ferring strips are not visible, thereby preserving the aesthetic look of the siding.

As disclosed above, it is useful to have a mechanism for easy installation and removal of portions of sidings. In some aspects, such a mechanism may involve the use of one or more clips attached to the siding portions. In some aspects, the clips may be configured to be affixed to one siding portion and may have components to allow removable coupling with an adjacent siding portion. In some aspects, the clips may also be configured to be affixed to one or more ferring strips on which the siding portions may be mounted. In some additional aspects, the clips may be configured so that a single assembler may be able to assemble multiple siding portions together. In yet another aspect, the clips may be configured to permit air motion across the ferring strips. These are other aspects may be advantageously incorporated in a siding clip disclosed herein.

FIG. 2 depicts one aspect of a siding clip 200. The clip 200 includes a top tab 205, a bottom base 210, and a side portion 215 connecting an edge of the top tab 205 with an edge of the bottom base 210. The top tab 205 overlaps at least a portion of the bottom base 210. The side portion 215 creates a spaced gap 220 between the top tab 205 and the bottom base 210. The spaced gap 220 is dimensioned to permit an edge or an edged portion (such as a lip) of a siding portion to be inserted therein. The top tab 205 also includes a tab through hole 225 that is disposed directly above a base through hole 230 disposed in the bottom base 210. The tab through hole 225 and the base through hole 230 are disposed in a geometry to permit a fastening device, such as a screw, a pin, a dowel, or a nail, to be inserted therethrough. One example of a fastening device may be a #8 flathead screw. It may be understood that such a geometry of the tab through hole 225 and the base through hole 230 may permit the fastening device to be inserted through the tab through hole 225, through the edge or edged portion of the siding portion inserted within the gap 220, and then through the base through hole 230. In this manner, the siding portion may be fixed within the gap 220 of the siding clip 200 and prevented from moving either horizontally (in or out of the gap 220) or laterally with respect to the siding clip 200. In some aspects, the fastening device may be long enough to engage a ferring strip disposed adjacent to the siding clip 200 and the siding portion, thereby affixing the siding portion proximate to the ferring strip. It may be recognized that the thickness of the siding clip 200 may provide an air gap between the siding portion and the ferring strip, thereby permitting air motion laterally across the face of the ferring strip.

The siding clip 200 may further include one or more coupling flanges 235*a,b*. The one or more coupling flanges 235*a,b* may be essentially co-planar with the top tab 205, and may be disposed in a direction opposite to the top tab 205. In some examples, a plane of the one or more coupling flanges 235*a,b* may be offset from the plane of the top tab 205. In some aspects, the plane of the one or more coupling flanges 235*a,b* offset from the plane of the top tab 205 may nevertheless be effectively parallel to the plane of the top tab 205. It may be understood that the one or more coupling flanges 235*a,b* may be disposed not to overlap the bottom base 210.

The one or more coupling flanges 235*a,b* may include insertion features 240*a,b* configured for insertion into a side groove fabricated into a second siding portion. In some aspects, the insertion features 240*a,b* may include one or more essentially triangular teeth. Non-limiting examples of such insertion features 240*a,b* may include one triangular tooth, two triangular teeth, three triangular teeth, four triangular or any integer number of triangular teeth. However, it may be recognized that the insertion features 240*a,b* may have any form suitable for engaging a groove in a siding portion. For example, the insertion features 240*a,b* may have a crenelated aspect having alternating extending portions and spaces. The extending portions may be triangular (toothed or dentate), rectangular, rounded, or any other shape. Alternatively, the insertion features 240*a,b* may have a shape of a corrugated fastener.

Figure 3:
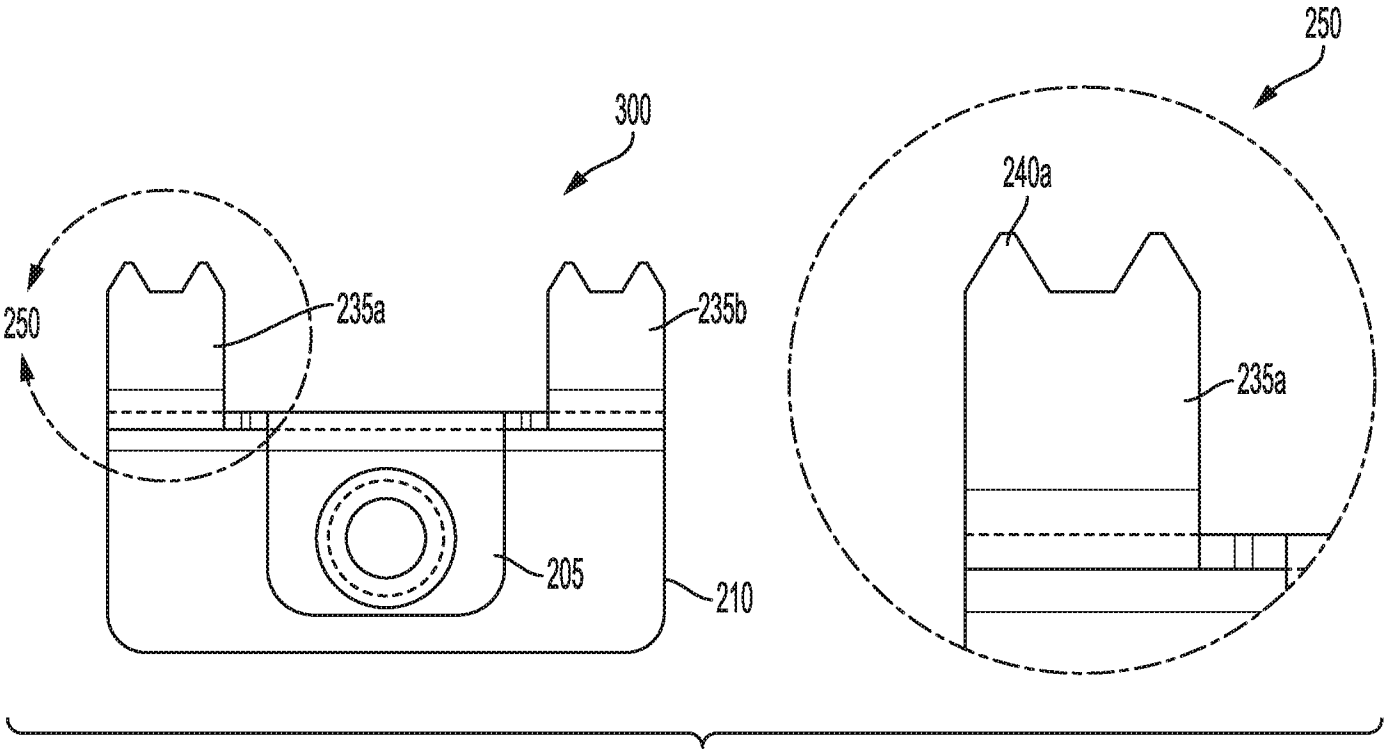
FIG. 3 depicts a top plan view of the siding clip depicted in FIG. 2 in accordance with at least one aspect of the present disclosure.

FIG. 3 depicts a plan top view of the aspect of a siding clip 200 depicted in FIG. 2. In particular, FIG. 3 depicts the top tab 205 overlapping the bottom base 210 and a pair of coupling flanges 235*a,b* disposed in an opposing direction to the top tab 205. A detailed view 250 of FIG. 3 depicts one of the coupling flanges 235*a*, particularly illustrating a bidentate example of the insertion features 240*a*. As disclosed above, the insertion features 240*a,b* may be composed of any number of components such as a single triangular tooth or multiple triangular teeth (two, three or more).

FIG. 4A depicts a side plan view of the aspect of the siding clip 200 depicted in FIG. 2. FIG. 4A particularly illustrates the gap 220 between the top tab 205 and the bottom base 210. FIG. 4A also depicts a spacer 245 placed within the gap 220. The plane of the coupling flanges 235*a,b* may be coplanar with a plane of the spacer 245. FIG. 4A further illustrates that the coupling flanges 235*a,b* may point in a direction opposite to that of the top tab 205 and does not overlap the bottom base 210. FIG. 4B depicts a front plan view of the aspect of the siding clip 200 depicted in FIG. 2. In particular, FIG. 4B illustrates that the top tab 205 is located centrally above the bottom base 210.

It may be recognized that the siding clip 200 depicted in FIGS. 2-4A,B, may have any dimensions appropriate for its function. For example, the gap 220 may be dimensioned to accept an edge or a portion of an edge (such as a lip) of a siding portion depending on the thickness of the edge or portion of the edge. Each of the coupling flanges 235*a,b* may have a width dimensioned for insertion in an edge groove of a siding portion depending on the depth of the edge groove of the siding portion. Nevertheless, one non-limiting example of the siding clip 200 depicted in FIGS. 2-4A,B may have the following dimensions. In one aspect, the bottom base 210 of the siding clip 200 may be about 1.5 inches long and about 0.6 inches wide. In one aspect, the top tab 205 may be about 0.64 inches long and about 0.5 inches wide. In one aspect, the tab through hole 225 may have a radius of about 0.21 inches. In one aspect, the gap 220 between the top tab 205 and the bottom base 210 may be about 0.325 inches. In one aspect, the coupling flanges 235*a,b* may have a width of about 0.31 inches and a length to the end of the insertion features 240*a,b* of about 0.45 inches. In one aspect, the thickness of the metal portion comprising the siding clip 200 may be about 0.046 inches.

FIG. 5 illustrates a front perspective view of the siding clip 200 depicted in FIGS. 2-4A,B associated with a siding portion 505. It may be observed that a lip portion 510 of the siding portion 505 is inserted into the gap between the top tab 205 and the bottom base (not shown). The tab through hole 225, located in the top tab 205, is beveled to receive the head of a flathead screw. FIG. 6 illustrates a side perspective view of the siding clip 200 and the siding portion 505 illustrated in FIG. 5. The lip portion 510 of the siding portion 505 is clearly observed in the gap 220 between the top tab and the bottom base. The two bidentate coupling flanges 240*a,b* are also depicted.

FIG. 7 illustrates an example of a siding portion 700 that may be used with the siding clip depicted in FIGS. 2-4A,B and disclosed above. The siding portion 700 includes a lip portion 705 one side of the siding portion 700 and a groove 710 in the edge opposite to the lip portion 705. It may be recognized that the particular shapes and sizes of the lip portion 705 and the groove 710 are not limiting. Nevertheless, as depicted in FIG. 7, a non-limiting example of the siding portion 700 may have a thickness of about 0.75 inches at the center of the siding portion 700. The lip 705 of the siding portion may have a thickness of about 0.315 inches and a width of about 0.55 inches. The edge opposing the lip 705 may have a have a bottom section 715 undercut from the top section. As a non-limiting example, the bottom section 715 may be undercut by about 0.62 inches. The groove 710 may have a depth of about 0.367 inches as measured from the end of the undercut bottom section. It may be recognized that such dimensions are non-limiting, and any siding portion may have a shape, size, or dimensions that may permit its use with the siding clips herein disclosed.

FIG. 8 depicts another example of a siding clip 800. The example of a siding clip 800 depicted in FIG. 8 may find especial use for adjoining siding portions. Particularly, the siding clip 800 depicted in FIG. 8 may be used to join two laterally adjacent siding portions. Such a siding clip 800 may be used, for example, to join the butt end of a first siding portion against a butt end of a second siding portion. It may be observed that many features of the siding clip 800 depicted in FIG. 8 are similar to those depicted in the siding clip 200 depicted in FIG. 2.

FIG. 8 depicts a second aspect of a siding clip 800. The siding clip 800 includes two top tabs 805*a,b*, a bottom base 810, and a side portion 815 connecting an edge of each of the two top tabs 805*a,b* with an edge of the bottom base 810. Each of the two top tabs 805*a,b* overlaps at least a portion of the bottom base 810. The two top tabs 805*a,b* may also be mutually co-planar. The side portion 815 creates a spaced gap 820 between the top tabs 805*a,b* and the bottom base 810. The spaced gap 820 is dimensioned to permit an edge or an edged portion (such as a lip) of a siding portion to be inserted therein. Each of the top tabs 805*a,b* includes a tab through hole 825*a,b* that is disposed directly above a bottom base through hole 830*a,b*, respectively. It may be observed that a total of four through holes 825*a,b* and 830*a,b* are depicted in FIG. 8: one through hole 825*a,b* in each of the two top tabs 805*a,b*, respectively, and a through hole in the bottom base (830*a,b*) opposite each of the top tab through holes 825*a,b*. Each of the top tab through hole 825*a,b* and its opposing bottom base through hole 830*a,b* is disposed in a geometry to permit a fastening device, such as a screw, a pin, a dowel, or a nail, to be inserted therethrough. One example of a fastening device may be a #8 flathead screw. It may be understood that such a geometry of each of the top tab through holes 825*a,b* and opposing bottom base through hole 830*a,b* may permit the fastening device to be inserted through the top tab through hole 825*a,b*, through the edge or edged portion of a siding portion inserted within the gap 820, and then through an opposing bottom base through hole 830*a,b*. In this manner, a siding portion may be fixed within the gap 820 of the siding clip and prevented from moving either horizontally (in or out of the gap) or laterally with respect to the siding clip 800. In some aspects, the fastening device may be long enough to engage a ferring strip disposed adjacent to the siding clip 800 and one or more siding portions, thereby affixing the one or more siding portions proximate to the ferring strip. It may be recognized that the thickness of the siding clip 800 may provide an air gap between the siding portion and the ferring strip, thereby permitting air motion laterally across the face of the ferring strip.

The siding clip 800 may further include one or more coupling flanges 835. The one or more coupling flanges 835 may be essentially co-planar with the top tabs 805*a,b*, and may be disposed in a direction opposite to the top tabs 805*a,b*. In some examples, a plane of the one or more coupling flanges 835 may be offset from the plane of the top tabs 805*a,b*. In some aspects, the plane of the one or more coupling flanges 835 offset from the plane of the top tabs 805*a,b* may nevertheless be effectively parallel to the plane of the top tabs 805*a,b*. It may be understood that the one or more coupling flanges 835 may be disposed not to overlap the bottom base 810. The one or more coupling flanges 835 may include insertion features 840*a,b* configured for insertion into a side groove fabricated into a second siding portion. In some aspects, the insertion features 840*a,b* may include one or more essentially triangular teeth.

As disclosed above, the aspect of the siding clip 800 in FIG. 8 may find especial use for joining two laterally adjacent siding portions together. Thus, a first top tab (for example 805*a*) and the bottom base 810 may engage a first siding portion and a second top tab (for example 805*b*) and the bottom base 810 may engage a second siding portion so that a butt end of the first siding portion is proximate or adjacent to a butt end of the second siding portion. A first fastening device may be inserted through the first top tab through hole 825*a* of the first top tab 805*a*, passing through a section of the first siding portion, continue through a first base through hole 830*a* and engage a portion of a ferring strip underneath. Similarly, a second fastening device may be inserted through the second tab through hole 825*b* of the second top tab 805*b*, passing through a section of the second siding portion, continue through a second bottom base through hole 830*b* and engage a portion of a ferring strip underneath. While the single top tab 205 of the siding clip 200 depicted in FIG. 2 may be centrally located along a length of the siding clip 200, each of the two top tabs 805*a,b* of the siding clip 800 depicted in FIG. 8 may be located proximate to a lateral edge of the siding clip 800. The disposition and configuration of the coupling flanges 235*a,b* of the siding clip 200 depicted in FIG. 2 may also differ from the disposition an configure of the coupling flange 825 of the siding clip 800 depicted in FIG. 8. The siding clip 200 illustrated in FIG. 2 has two coupling flanges 235*a,b*, in which each coupling flange 235*a* and 235*b* is disposed proximate to a lateral edge of the siding clip 200 on opposing lateral sides of the single top tab 205. However, the siding clip 800 illustrated in FIG. 8, has a single coupling flange 835 disposed centrally between the two top tabs 805*a,b* and includes two insertion features 840*a,b*. In this manner, the single elongated coupling flange 835 may engage a groove of each of two laterally mounted siding portions.

FIG. 9 depicts a plan top view of the aspect of a siding clip 800 depicted in FIG. 8. In particular, FIG. 9 depicts the first top tab 805*a* and the second top tab 805*b* overlapping the bottom base 810. FIG. 9 further depicts a single coupling flange 835 disposed in an opposing direction to the two top tabs 805*a,b*. The coupling flange 835 further includes two bidentate insertion features 840*a,b*, in which a first insertion feature (for example 840*a*) may be configured to engage a groove of a first siding portion and a second insertion feature (for example 840*b*) is configured to engage a groove of a second, laterally displace, siding portion.

Figure 10B:
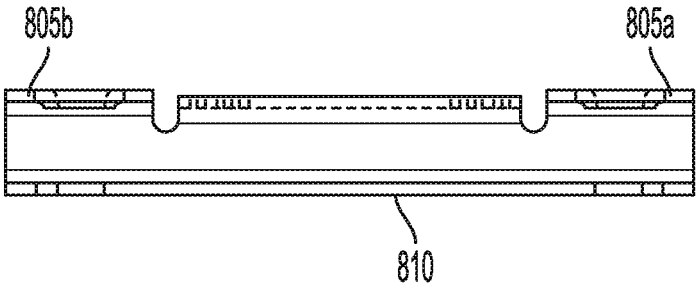

FIG. 10A depicts a side plan view of the aspect of the siding clip 800 depicted in FIG. 8. FIG. 10A particularly illustrates the gap 820 between each of the top tabs 805*a,b* and the bottom base 810 (note that in this view, only the edge of top tab 805*a* is shown). FIG. 10A also includes a spacer (a pair of spacers 845*a,b* of which only spacer 845*a* is shown) within the gap 820 which may be associated with each of the top tab through holes 825*a,b* (only top tab through hole 825*a* is shown). The plane of the coupling flange 835 may be coplanar with a plane of the spacers 845*a,b*. FIG. 10A further illustrates that the coupling flange 835 points in a direction opposite to that of the top tabs 805*a,b* and does not overlap the bottom base 810. FIG. 10B depicts a front plan view of the aspect of the siding clip 800 depicted in FIG. 8. In particular, FIG. 10B illustrates that each of the top tabs 805*a,b* is located proximate to a lateral end of the siding clip 800 and above the bottom base 810.

It may be recognized that the siding clip 800 depicted in FIGS. 8-10A,B, may have any dimensions appropriate for its function. For example, the gap 820 may be dimensioned to accept an edge or a portion of an edge (such as a lip) of a siding portion depending on the thickness of the edge or portion of the edge of the siding portion or siding portions. The coupling flange 835 may have a width dimensioned for insertion in an edge groove of a siding portion or of multiple siding portions depending on the depth of the edge groove or grooves. Nevertheless, one non-limiting example of the siding clip 800 depicted in FIGS. 8-10A,B may have the following dimensions. In one aspect, the bottom base 810 of the siding clip 800 may be about 3.0 inches long and about 0.65 inches wide. In one aspect, each of the two top tabs 805*a,b* may be about 0.64 inches long and about 0.5 inches wide. In one aspect, each top tab through hole 825*a,b* may have a radius of about 0.21 inches. In one aspect, the gap 820 between the top tabs 805*a,b* and the bottom base 810 may be about 0.325 inches. In one aspect, the coupling flange 835 may be disposed between the two top tabs 805*a,b* and may have a width of about 0.31 inches and a length of about 1.5 inches. In one aspect, the thickness of the metal portion comprising the clip 800 may be about 0.046 inches.

FIG. 11 illustrates an aspect of a use of the siding clip 800 depicted in FIGS. 8-10A,B. As illustrated in FIG. 11, a first siding portion 1105*a* may be engaged by the first top tab 805*a* and the bottom base 810 (not shown) and a second siding portion 1105*b* maybe engaged by the second top tab 805*b* and the bottom base 810 (not shown). In some aspects, the butt end of the first siding portion 1110*a* may contact the butt end of the second siding portion 1110*b*. In some other aspects, a gap may be located between the butt end of the first siding portion 1110*a* and the butt end of the second siding portion 1110*b*. In yet another aspect, a spacing material 1115 may be disposed between the butt end of the first siding portion 1110*a* and the butt end of the second siding portion 1110*b*. Such spacing material 1115 may be used to form a weather-proof seal between the butt end of the first siding portion 1110*a* and the butt end of the second siding portion 1110*b*.

FIG. 12 illustrates an aspect of an assembly 1200 of multiple siding portions 1205*a-c* together by the use of the siding clip 800 depicted in FIGS. 8-10A,B. It may be seen that a portion of an upper siding portion 1205*a* overlaps the lips of the two siding portions 1205*b,c* therebelow. A groove of the upper siding portion 1205*a* engages the coupling flange 835 of the siding clip 800. In some examples, the assembly 1200 may have a single upper siding portion 1205*a* overlapping two lower siding portions 1205*b,c*, as illustrated in FIG. 12. In another aspect, two upper siding portions may each engage a portion of the coupling flange 835 of the siding clip 800. The two upper siding portions may physically adjoin each other at their respective butt ends, or a spacing material may be disposed between the butt ends of the two upper siding portions (see, for example, spacing material 1115 illustrated in FIG. 11).

Disclosed above are aspects of a siding clip that may be used in the fabrication of a siding wall against an exterior of a building. Although the particular numbers and shapes of the siding clip are explicitly disclosed, it may be recognized that variations within the scope of this disclosure may also be considered. For example, the number of tabs may include one, two, or multiple tabs depending on the intended use of the siding clip. The base may be a single component or may include multiple base components. Any number of coupling flanges may be incorporated into the siding clip, and the coupling flanges may include any of a variety of insertion features so that they can engage a groove of a siding portion.

While several forms have been illustrated and described, it is not the intention of the applicant to restrict or limit the scope of the appended claims to such detail. Numerous modifications, variations, changes, substitutions, combinations, and equivalents to those forms may be implemented and will occur to those skilled in the art without departing from the scope of the present disclosure. Moreover, the structure of each element associated with the described forms can be alternatively described as a means for providing the function performed by the element. Also, where materials are disclosed for certain components, other materials may be used. It is therefore to be understood that the foregoing description and the appended claims are intended to cover all such modifications, combinations, and variations as falling within the scope of the disclosed forms. The appended claims are intended to cover all such modifications, variations, changes, substitutions, modifications, and equivalents.

One or more components may be referred to herein as "configured to," "configurable to," "operable/operative to," "adapted/adaptable," "able to," "conformable/conformed to," etc. Those skilled in the art will recognize that "configured to" can generally encompass active-state components and/or inactive-state components and/or standby-state components, unless context requires otherwise.

The terms "proximal" and "distal" are used herein with reference to a clinician manipulating the handle portion of the surgical instrument. The term "proximal" refers to the portion closest to the clinician and the term "distal" refers to the portion located away from the clinician. It will be further appreciated that, for convenience and clarity, spatial terms such as "vertical", "horizontal", "lateral," "up", and "down" may be used herein with respect to the drawings. However, surgical instruments are used in many orientations and positions, and these terms are not intended to be limiting and/or absolute.

Those skilled in the art will recognize that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flow diagrams are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

It is worthy to note that any reference to "one aspect," "an aspect," "an exemplification," "one exemplification," and the like means that a particular feature, structure, or characteristic described in connection with the aspect is included in at least one aspect. Thus, appearances of the phrases "in one aspect," "in an aspect," "in an exemplification," and "in one exemplification" in various places throughout the specification are not necessarily all referring to the same aspect. Furthermore, the particular features, structures or characteristics may be combined in any suitable manner in one or more aspects.

Any patent application, patent, non-patent publication, or other disclosure material referred to in this specification and/or listed in any Application Data Sheet is incorporated by reference herein, to the extent that the incorporated materials is not inconsistent herewith. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

In summary, numerous benefits have been described which result from employing the concepts described herein. The foregoing description of the one or more forms has been presented for purposes of illustration and description. It is not intended to be exhaustive or limiting to the precise form disclosed. Modifications or variations are possible in light of the above teachings. The one or more forms were chosen and described in order to illustrate principles and practical application to thereby enable one of ordinary skill in the art to utilize the various forms and with various modifications as are suited to the particular use contemplated. It is intended that the claims submitted herewith define the overall scope.

Various aspects of the subject matter described herein are set out in the following numbered examples:

Example 1. A siding clip comprising:

at least one tab comprising a tab through hole;

a base comprising at least one base through hole;

a side portion affixed to an edge of the at least one tab at a first side portion end and to an edge of the base at a second side portion end, thereby forming a gap between the at least one tab and the base, wherein the tab through hole is disposed opposite to one of the at least one base through holes; and at least one coupling flange having a plane parallel to a plane of the at least one tab and comprising at least one insertion feature, wherein the at least one coupling flange is disposed in a direction opposite to a direction of the at least one tab.

Example 2. The siding clip of Example 1, wherein the at least one tab comprises a single tab, and the at least one base through hole comprises a single base through hole and the tab through hole of the single tab is disposed opposite to the single base through hole.

Example 3. The siding clip of any one or more of Examples 1 through 2, wherein the at least one tab is centered along a lateral length of the siding clip.

Example 4. The siding clip of any one or more of Examples 1 through 3, wherein the at least one coupling flange comprises two coupling flanges, and a first coupling flange is disposed proximate to a first lateral end of the siding clip and the second coupling flange is disposed proximate to a second lateral end of the siding clip.

Example 5. The siding clip of Example 4, wherein the first coupling flange comprises a first bidentate insertion feature and the second coupling flange comprises a second bidentate insertion feature.

Example 6. The siding clip of any one or more of Examples 1 through 5, wherein the gap is configured to receive an edge of a first siding portion.

Example 7. The siding clip of any one or more of Examples 1 through 6, wherein the at least one coupling flange is configured to be received by an edge groove of a second siding portion.

Example 8. The siding clip of any one or more of Examples 1 through 7, wherein the at least one tab comprises a first tab and a second tab, and the at least one base through hole comprises a first base through hole and a second base through hole.

Example 9. The siding clip of Example 8, wherein the first tab is disposed proximate to a first lateral end of the siding clip and the second tab is disposed proximate to a second lateral end of the siding clip.

Example 10. The siding clip of any one or more of Examples 8 through 9, wherein a tab through hole of the first tab is disposed opposite to the first base through hole and a tab through hole of the second tab is disposed opposed to the second base through hole.

Example 11. The siding clip of any one or more of Examples 8 through 10, wherein the at least one coupling flange comprises a single coupling flange disposed medially between the first tab and the second tab.

Example 12. The siding clip of Example 11, wherein the coupling flange comprises a first bidentate insertion feature and a second bidentate insertion feature.

Example 13. The siding clip of Example 12, wherein the first bidentate insertion feature is disposed proximate to a first lateral end of the coupling flange and the second bidentate insertion feature is disposed proximate to a second lateral end of the coupling flange.

Example 14. The siding clip of any one or more of Examples 8 through 13, wherein the gap is configured to receive an edge of a fourth siding portion between the first tab and the base, and the gap is configured to receive an edge of a fifth siding portion between the second tab and the base.

Example 15. The siding clip of any one or more of Examples 11 through 14, wherein the coupling flange is configured to be received by an edge groove of at least a sixth siding portion.

What is claimed is:

1. A siding clip comprising:

a single tab comprising a single tab through hole;

a base comprising a single base through hole, wherein the single base through hole is disposed in a medial longitudinal portion of the base;

a side portion affixed to an edge of the single tab at a first side portion end and to an edge of the base at a second side portion end, thereby forming a gap between the single tab and the base, wherein the single tab through hole is disposed opposite to the single base through hole; and at least one coupling flange having a plane parallel to a plane of the single tab and comprising at least one insertion feature, wherein the at least one coupling flange is disposed in a direction opposite to a direction of the single tab, and wherein a longitudinal extent of the single tab overlaps only the medial portion of the base.

2. The siding clip of claim 1, wherein the single tab is centered along a lateral length of the siding clip.

3. The siding clip of claim 1, wherein the at least one coupling flange comprises two coupling flanges, and a first coupling flange is disposed proximate to a first lateral end of the siding clip and the second coupling flange is disposed proximate to a second lateral end of the siding clip.

4. The siding clip of claim 3, wherein the first coupling flange comprises a first bidentate insertion feature and the second coupling flange comprises a second bidentate insertion feature.

5. The siding clip of claim 1, wherein the gap is configured to receive an edge of a first siding portion.

6. The siding clip of claim 1, wherein the at least one coupling flange is configured to be received by an edge groove of a second siding portion.

7. A siding clip comprising:

at least one tab comprising a tab through hole;

a base comprising at least one base through hole;

a side portion affixed to an edge of the at least one tab at a first side portion end and to an edge of the base at a second side portion end, thereby forming a gap between the at least one tab and the base, wherein the tab through hole is disposed opposite to one of the at least one base through holes; and at least one coupling flange having a plane parallel to a plane of the at least one tab and comprising at least one insertion feature, wherein the at least one coupling flange is disposed in a direction opposite to a direction of the at least one tab wherein the at least one tab comprises a first tab and a second tab, and the at least one base through hole comprises a first base through hole and a second base through hole, and wherein the at least one coupling flange comprises a single coupling flange disposed medially between the first tab and the second tab.

8. The siding clip of claim 7, wherein the first tab is disposed proximate to a first lateral end of the siding clip and the second tab is disposed proximate to a second lateral end of the siding clip.

9. The siding clip of claim 7, wherein a tab through hole of the first tab is disposed opposite to the first base through hole and a tab through hole of the second tab is disposed opposed to the second base through hole.

10. The siding clip of claim 7, wherein the coupling flange comprises a first bidentate insertion feature and a second bidentate insertion feature.

11. The siding clip of claim 10, wherein the first bidentate insertion feature is disposed proximate to a first lateral end of the coupling flange and the second bidentate insertion feature is disposed proximate to a second lateral end of the coupling flange.

12. The siding clip of claim 7, wherein the gap is configured to receive an edge of a fourth siding portion between the first tab and the base, and the gap is configured to receive an edge of a fifth siding portion between the second tab and the base.

13. The siding clip of claim 7, wherein the coupling flange is configured to be received by an edge groove of at least a sixth siding portion.

* * * * *